United States Patent [19]

Koefferlein et al.

[11] Patent Number: 4,952,979

[45] Date of Patent: Aug. 28, 1990

[54] ISORUNNING-COUNTERRUNNING DEVELOPER STATION FOR AN ELECTROPHOTOGRAPHIC MEANS

[75] Inventors: Rainer Koefferlein, Muenchen; Bernhard Schlageter, Unterhaching; Erich Baier, Schweitenkirchen, all of Fed. Rep. of Germany

[73] Assignee: Siemens Aktiengesellschaft, Berlin and Munich, Fed. Rep. of Germany

[21] Appl. No.: 331,666

[22] PCT Filed: Sep. 21, 1987

[86] PCT No.: PCT/DE87/00429

§ 371 Date: Mar. 22, 1989

§ 102(e) Date: Mar. 22, 1989

[87] PCT Pub. No.: WO88/02507

PCT Pub. Date: Apr. 7, 1988

[30] Foreign Application Priority Data

Sep. 24, 1986 [DE] Fed. Rep. of Germany ..... 3632441

[51] Int. Cl.[5] ..... G03G 15/09

[52] U.S. Cl. ..... 355/251; 118/658

[58] Field of Search ..... 355/251, 245, 268; 118/657, 658; 430/100, 122

[56] References Cited

U.S. PATENT DOCUMENTS

| | | | |
|---|---|---|---|
| 3,881,446 | 5/1975 | Kurita | 118/657 |
| 3,883,240 | 5/1975 | Ito et al. | 355/253 |
| 3,911,864 | 10/1975 | Hudson | 118/648 |
| 3,912,388 | 10/1975 | Takahashi et al. | 355/260 |
| 4,098,228 | 7/1978 | Ruckdeschel et al. | 118/658 |
| 4,430,957 | 2/1984 | Cherbuy et al. | 118/657 |
| 4,442,790 | 4/1984 | Swapceinski et al. | 118/657 |
| 4,461,238 | 7/1984 | Baier et al. | 118/658 |
| 4,469,427 | 9/1984 | Kopp et al. | 355/215 |
| 4,538,901 | 9/1985 | Soumiya | 355/273 |

FOREIGN PATENT DOCUMENTS

| | | | |
|---|---|---|---|
| 222435 | 5/1985 | Fed. Rep. of Germany | 355/251 |
| 1524543 | 9/1978 | United Kingdom . | |
| 2141047 | 12/1984 | United Kingdom | 355/251 |

OTHER PUBLICATIONS

Patent Abstracts of Japan, vol. 8, No. 144 (P-284) (1581) Jul. 5, 1984, 59-42570.

Patent Abstracts of Japan, vol. 7, No. 196 (P-219) (141) Aug. 26, 1983, 58-93083.

Patent Abstracts of Japan, vol. 9, No. 72 (P-345) (1795) Apr. 2, 1985, 59-204062.

Patent Abstracts of Japan, vol. 10, No. 206 (P-478) (2262) Jul. 18, 1986, 61-46969.

Patent Abstracts of Japan, vol. 10, No. 135 (P-457) (2192) May 20, 1986, 60-256184.

*Primary Examiner*—Joan H. Pendegrass

*Attorney, Agent, or Firm*—Hill, Van Santen, Steadman & Simpson

[57] ABSTRACT

An isorunning-counterrunning developer station comprises a plurality of isorunning developer drums moving isodirectionally with the charge image carrier and one counterruning developer drum. A developer mix is offered to the first isorunning developer drum via a paddle wheel proceeding from a supply chamber and is conducted from the first isorunning developer drum to the counterrunning developer drum via further isorunning developer drums. An exposure means composed of a transparent protective tube having a LED strip contained therein is provided above the developer drum, this exposure means being in turn followed by a carrier stripper drum.

9 Claims, 2 Drawing Sheets

ISORUNNING-COUNTERRUNNING DEVELOPER STATION FOR AN ELECTROPHOTOGRAPHIC MEANS

BACKGROUND OF THE INVENTION

The invention is directed to a developer station in an electrophotographic means for the development of charge images applied to charge image carriers with the assistance of a developer mix, whereby the developer mix is taken from a supply chamber in a developer station by a transport drum and is transported to developer drums that rotate in opposite directions relative to one another and ink the charge image carrier.

In copier equipment technology and in non-mechanical fast data printers that operate based on the principle of electrophotography, charge images are generated on a charge image carrier, for example on a photoconductive drum, and are subsequently inked with a colored powder, toner in a developer station. The toner images are subsequently transferred onto normal paper given employment of a photoconductive drum and are fixed there.

As a rule, a two-component developer is employed for developing, this being composed of ferromagnetic carrier particles and of colored toner particles. The developer mix, for example, is conducted past the charge image on the charge image carrier with a magnetic brush arrangement, the toner particles adhering to the charge image as a result of electrostatic forces. The magnetic brush arrangement is thereby composed of a rotatable hollow cylinder in whose interior a plurality of rows of stationary permanent magnets are arranged. A plurality of magnetic brush arrangements can be provided in one developer station. For example, one magnetic brush arrangement can serve the purpose of transporting the developer mix past the charge image carrier, referred to below as developer drum. A further magnetic brush arrangement can be employed in order to transport the developer mix out of the inside of the developer station to the developer drum. Such a magnetic brush arrangement or any other arrangement that effects such a transport of developer mix is thereby referred to as transport drum below. Developer stations wherein developer mix for inking the charge images on the charge image carrier with the assistance of the magnetic brush principle are employed are disclosed by German Patent 31 19 010 and corresponding U.S. Pat. No. 4,461,232.

When developer drums are operated such that the developer mix is applied in the moving direction of the charge image carrier, one speaks of isorunning developer drums or co-running developer drums. When the developer mix is applied opposite the moving direction of the charge image carrier with the assistance of the developer drums, then such developer drums are referred to as counterrunning developer drums.

Developer stations that contain both counterrunning as well as isorunning developer drums are disclosed, for example, by US-A-3,912,388 and by US-A-3,881,446. The developer drums additionally have a metering means allocated to them that is composed of an adjustable blade and that serves the purpose of impressing a defined height or, respectively, thickness on the carpet of mix on the developer drums. The developer mix is thereby simultaneously offered to both drums from the supply space.

Developer stations having isorunning developer drums as disclosed, for example, by GB-A-1 524 543 have good printing results given line-like patterns such as, for example, characters. The inking is unsatisfactory given full surfaces such as occur, for example, in graphic illustrations or given black bars as needed, for example, when printing bar codes.

Numerous attempts have been made in order to be able to satisfactorily accomplish the full-surface inking. Thus, a better full-surface inking without modification of the developer station can be achieved when the toner and/or the carrier material in the developer mix is changed. In all such instances, however, a considerable reduction of the useful life of the mix has hitherto also derived, this being a great disadvantage because of the higher costs for material consumption and maintenance connected therewith.

A further possibility of improving the full-surface inking is comprised in switching from the reversal development method wherein the discharged regions of the charge image carrier are inked to the direct development method standard in copier technology wherein the charged regions are inked. Given direct development, however, the majority part of the surface of the charge image carrier must usually be exposed. This largely excludes the employment of specific character generator principles such as, for example, LED lines or the employment of laser diodes because of the thermic problems connected therewith. However, it is precisely these two character generator principles that come into consideration when high point grid density given high printing process speed are required.

Further attempts for improving the full-surface inking have shown that no uniform surface inking can be achieved with a single developer drum given the established marginal conditions (composition of the toner mix, speed). On the contrary, wash-out effects at the trailing edge of the full surfaces given isorunning development or, respectively, at the leading edge of the full surface given counterrunning development are observed therein, these having an especially disturbing effect in critical image patterns, for example inverse printing.

Disturbances in the printer format, particularly light spots, form a further problem in such developer stations, these light spots deriving therefrom that the carrier particles contained in the developer mix are entrained by the photoconductive layer of the photoconductive drum up to the transfer station and deteriorate the transfer printing event. The standard magnetic carrier stripper drum is not in a position by itself to reliably avoid this disturbance.

SUMMARY OF THE INVENTION

It is an object of the-in to fashion a developer station of the species initially cited such that a high printing quality given high process speed is possible upon employment of a developer mix having a high useful life of the mix.

In a developer station of the species initially cited, this object is achieved in that the developer station is fashioned as an isorunning-counterrunning developer station wherein the developer mix is initially offered to the photoconductive drum via a plurality of developer drums moving isodirectionally, whereby the last developer drum is then fashioned as a developer drum that is moved counter-directionally. The circumferential speed of the isorunning developer drums is thereby noticeably higher than the circumferential speed of the charge image carrier. Even given employment of reversal development methods, this measure achieves an intense and uniform inking of the full surfaces given a high printing speed of, for example, 0.4 m/sec and more.

In an advantageous embodiment of the invention, an illumination means for the charge image carrier is provided following the developer drums in moving direction of the charge image carrier. This illumination means can be surrounded by a transparent, rotating protective drum that prevents the contamination of the LED strip or light-emitting foil serving as exposure elements.

After the actual development, this illumination means levels the charge image in that the highly charged and non-toner-covered regions of the charge image carrier are illuminated and, thus, discharged. Therewith, first, the adhesion of the "negative" charge particles to the photoconductor regions that were not exposed in character-dependent fashion is reduced, so that they can be stripped from the charge image carrier by a following carrier stripper drum and can be returned into the developer station. The memory effects on the charge image carrier due to charge images that are not completely quenched and that disturb the printed format can also be prevented by the illumination means.

The spacing of the illumination means from the counterrunning developer drum is adapted such that the surface of the protective tube composed of plexiglass is continuously cleaned of developer mix and the light exit is only slightly attenuated by adhering toner dust.

Given a further, advantageous embodiment of the invention, a suction means is provided between the plexiglass protective tube of the illumination means and the carrier stripper drum, this suction means suctioning the free toner mix—that is not bonded to the charge image carrier—off, so that it cannot be entrained upward out of the developer station.

The transfer of the carpet of developer mix from the last isorunning roller onto the counterrunning roller offers the additional advantage that non-magnetic particles, for example larger lumps of toner or paper particles that have collected in the developer mix after longer operation are downwardly hurled into the supply chamber from the mix after being transferred onto the counterrunning drum. The risk that such particles come into contact with the charge image carrier after the last developer drum and that they are entrained by the charge image carrier due to the electrostatic forces—this potentially leading to disturbances in the printed format—is considerably reduced.

Also having a disturbance-reducing effect is that the last developer drum having a moving direction running counter that of the charge image carrier is in the position to strip off such disturbing particles that already previously remained adhering to the surface of the charge image carrier and to convey them downward into the supply region together with the developer mix. In a further advantageous embodiment of the invention, the first and the second isorunning drum are arranged such that the developer mix, after passing the charge image carrier, falls back onto the transport drum that, for example, can be fashioned as a paddle wheel and is supplied from the latter to the second isorunning drum. The developer mix that is already somewhat depleted can thus be returned from the first developer drum into the supply chamber and well-blended developer mix can be transferred onto the second developer drum.

BRIEF DESCRIPTION OF THE DRAWINGS

Embodiments of the invention are shown in the drawings and shall be set forth in greater detail by way of example. Shown are.

DESCRIPTION OF THE PREFERRED EMBODIMENTS

Figure 1:
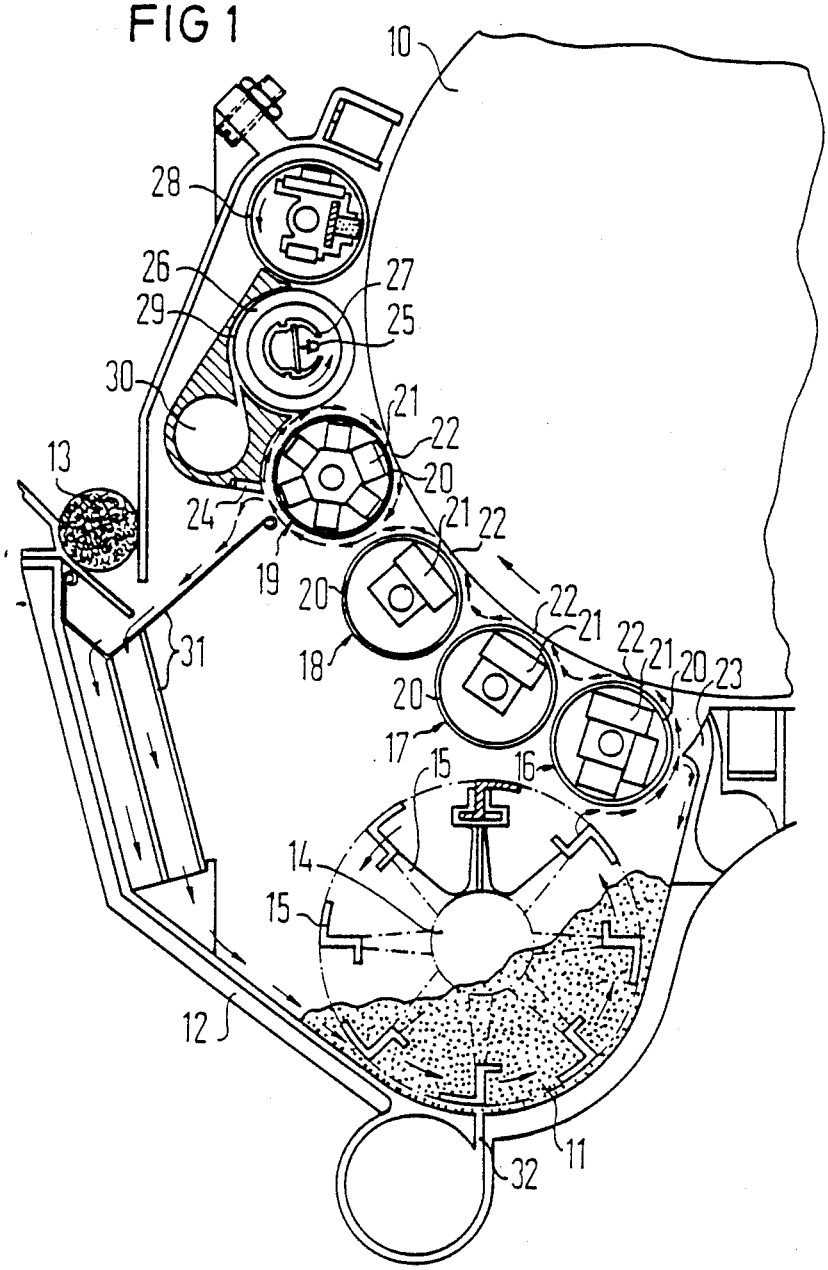
FIG. 1 a schematic sectional view of the developer station of the invention.

FIG. 1 shows a schematic sectional view of a developer station in a non-mechanical fast-printer means comprising the illumination means of the invention. A photoconductive drum 10 is arranged as charge image carrier in a printer means not shown in greater detail that operates according to the electrophotographic principle. A charge image is applied to this photoconductive drum in a known fashion via an exposure means that is controlled character-dependent and this charge image is then inked with the assistance of the illustrated developer station. The inking thereby ensues according to the reversal development principle wherein the regions discharged by the exposure are inked with the assistance of a developer mix 11 containing toner particles and carrier particles. After traversing the developer station, the charge images composed of colored toner particles are transferred onto paper in the standard way.

The developer station is essentially composed of a supply chamber 12 to which developer mix 11 is supplied via a filling aperture 13 comprising a drum of expanded material arranged therein as metering means. An electromotively driven conveyor drum in the form of a paddle wheel drum 14 that comprises spokelike paddles 15 for conveying the developer mix 11 is situated at the floor of the supply chamber 12. The supply chamber 12 is closed off from the photoconductive drum 10 by four developer drums 16, 17, 18 and 19. These developer drums arranged along the circumference of the photoconductive drum are situated at the tight spacing of about 1 through 2.5 mm from the surface of the photoconductive drum and operate according to the magnetic brush principle. They are essentially composed of hollow cylinders constantly driven via electromotive means, for example of aluminum having a knurled surface and having magnet arrangements 21 arranged therein. The hollow cylinders 20 are thereby charged with a bias voltage that exhibits approximately the size of 20 through 50% of the charge potential at the photoconductive drum. Given employment of a selenium photoconductive drum having a charge potential of 400 through 1000 volts, the bias voltage has the size of 100 through 500 volts.

Dependent on the moving direction of its hollow cylinders, the developer drums 16, 17 and 18 are fashioned as what are referred to as isorunning developer drums. Given these isorunning developer drums, the moving direction of their hollow cylinders corresponds to the moving direction of the surface of the photoconductive drum 10 in the region of the developing gap 22 formed by the hollow cylinder 20 and the surface of the photoconductive drum 10. The developer drum 19 is fashioned as a counterrunning developer drum wherein the hollow cylinder 20 moves in a direction opposite that of the photoconductive drum 10 in the development gap 22.

The transport of the developer mix 11 thereby ensues according to the arrows shown in FIG. 1 such that the developer mix 11 is offered to the first isorunning developer drum 16 from the mix sump floor of the supply chamber 12 via the paddle wheel drum 14. A metering doctor 23 thereby defines the height of the carpet of developer mix on the first isorunning drum 16 and, thus, on the following isorunning drums 17 and 18 as well. Since the developer mix has developed the charge image contained on the photoconductive surface three times with considerably higher speed than the photoconductive surface (about 1.5 times the process speed), namely with the assistance of the isorunning developer drums 16, 17 and 18, the developer mix transfers from the third isorunning drum 18 onto the under side of the significantly slower, fourth counterrunning developer drum that is driven in the opposite direction. A majority part of the developer mix is stripped off here by a further metering doctor 24; the remaining developer mix transported to the surface of the photoconductive drum 10 now develops the charge image a final time in counterrun. The spacings of the developer rollers advantageously lie under 2.5 mm, whereby the developing gap 22 has a width of 1 through 2.5 mm. The developer mix must be conveyed through this development gap 22 with optimally high density. The density of the developer mix must thereby be selected such that, first, the latent charge image is well-inked and, second, such that the surface of the charge image carrier is not damaged as a result of excessively great squeezing.

In order, first, to be able to transport the developer mix with the assistance of the developer drums but, on the other hand, in order to be able to enable an agglomeration of the toner particles on the charge image, the surface of the developer drums, as already set forth, is charged with a bias voltage of about 20 through 50% of the charge potential.

An illumination means in the form of a light-emitting diode strip or light-emitting foil 25 that is accomodated in a protective drum 26 composed of a transparent, rotating plexiglass tube is situated above the last developer drum fashioned as a counterrunning developer drum 19. Rotation and spacing from the counterrunning developer drum 19 are adapted such that the surface of the plexiglass tube 26 is continuously cleaned of developer mix 11 and the light exit region 27 of the light-emitting diode ledge 25 is only slightly attenuated by adhering toner dust. The light-emitting diode ledge thereby generates a spectral light that approximately corresponds to the light of the character generator—for, example, a LED comb.

Further, a carrier stripper drum 28 operating according to the magnetic brush principle in accord with the developer drums is situated above the illumination means, this carrier stripping drum 28 lifting the carrier particles of the developer mix from the surface of the photoconductive drum in collaboration with the illumination means and returning them to the developer mix 11 via a correspondingly fashioned guide channel.

Via the light-emitting diode ledge 25, the illumination means levels the charge image in that it illuminates the highly charged (about 400 through 1000 volts) and non-toner-covered regions of the surface of the photoconductive drum 10 and thereby discharges them down to a residual voltage of less than 50 volts that thus corresponds to the discharge voltage of the character generator. The adhesion of negative carrier particles of the developer mix to the non-exposed regions of the surface of the photoconductive drum 10 is thus reduced, so that they can be stripped from the surface of the photoconductive drum 10 by the following carrier stripper drum 28 and can be returned into the developer station. Simultaneously, memory effects due to charge images on the surface of the photoconductive drum that were not completely quenched can be prevented by the illumination means.

The illumination means generates a largely uniform charge image on the charge image carrier preceding the carrier stripper means and the following transfer station in the printer. The charge image carrier therewith comprises a uniform residual charge voltage of about 50 volts. This "image-wise" discharging thus facilitates not only the removal of the carrier particles from the photoconductive drum but it also promotes the transfer of the toner image onto the paper web in the transfer station. In order to guarantee the same penetration depth of the light into the surface of the charge image carrier as the light that is controlled in character-dependent fashion that generates the charge image, the light of the illumination means has approximately the same spectral structure as the light of the character generator. When for example, a light-emitting diode comb is employed as a character generator, then a similarly structured illumination means is recommendable. Instead of a LED line, a light-emitting foil can also be employed.

The illumination means is surrounded by a suction means that acts on the region between the carrier stripper drum 28 and the protective drum 26 via a suction channel 29 extending along the illumination means. This suction channel 29 is in communication with a suction blower (not illustrated here) via a suction collecting channel 30. This air extraction between the plexiglass tube (protective drum) 26 comprising the illumination means and the carrier stripping drum 28 generates a local underpressure and, thus, free toner dust that is not bonded by the charge image is collected in a container. The free toner dust can thus not be entrained upward out of the developer station by the photoconductive drum 10. Carrier particles stripped by the carrier stripping drum 28 and developer mix stripped by the metering doctor 24 of the counterrunning developer drum are returned into the supply chamber 12 via baffle plates 31.

An emptying aperture 32 via which used developer mix is suctioned off after a defined operating time is situated at the floor of the supply chamber 12.

Figure 2:
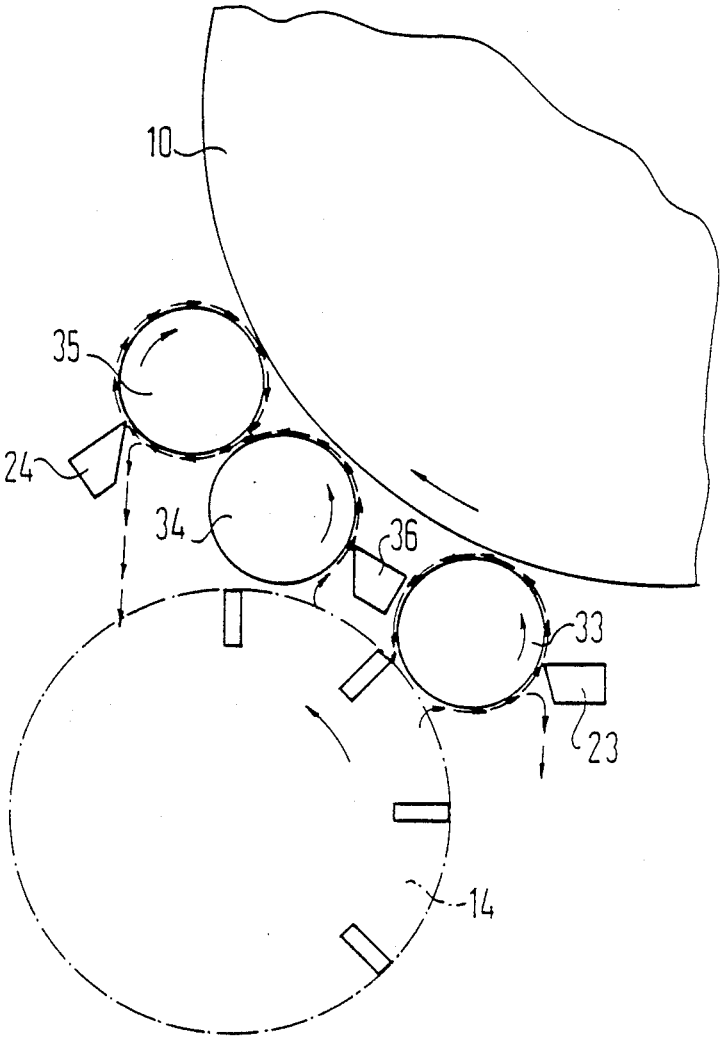
FIG. 2 a schematic illustration of an embodiment of the developer station comprising three developer drums.

Three developer drums 33, 34 and 35 are arranged in the embodiment of the developer station shown in FIG. 2. The developer drums 33 and 34 are a matter of isorunning developer drums; the developer drum 35 is a matter of a counterrunning developer drum. In this exemplary embodiment, the developer mix is first offered to the photoconductive drum 10 via the isorunning developer drum 33. The developer mix is then returned to the paddle wheel drum 14. The developer mix that is already somewhat depleted can thereby be enriched again with new developer mix and this newly enriched developer mix is then offered to the surface of the photoconductive drum again via the developer drum 34. It is thereby necessary to also allocate a metering doctor 36 to the developer drum 34. The counterrunning developer drum 35 arranged following thereupon corresponds in function to the counterrunning developer drum 19. Although other modifications and changes may be suggested by those skilled in the art, it is the intention of the inventors to embody within the patent warranted hereon all changes and modifications as reasonably and properly come within the scope of their contribution to the art.

| List of Reference Characters | |
|---|---|
| 10 | photoconductive drum |
| 11 | developer mix |
| 12 | supply chamber |
| 13 | filling aperture |
| 14 | paddle wheel drum |
| 15 | paddle |
| 16 | isorunning developer drum |
| 17 | isorunning developer drum |
| 18 | isorunning developer drum |
| 19 | counterrunning developer drum |
| 20 | hollow cylinder |
| 21 | permanent magnet |
| 22 | development gap |
| 23 | metering doctor |
| 24 | metering doctor |
| 25 | LED ledge |
| 26 | protective drum |
| 27 | light exit region |
| 28 | carrier stripper drum |
| 29 | suction channel |
| 30 | suction collecting channel |
| 31 | baffle plate |
| 32 | emptying aperture |
| 33 | isorunning developer drum |
| 34 | isorunning developer drum |
| 35 | counterrunning developer drum |
| 36 | metering doctor |

We claim:

1. A developer station in an electrophotographic means for the development of charge images applied to charge image carriers (10) with the assistance of a developer mix (11) is taken from a supply chamber (12) in a developer station by a transport drum (14) and is transported to developer drums (16 through 19) that rotate in opposite directions relative to one another and ink the charge image carrier (10), characterized in that the developer mix (11) is first transported to a first isorunning developer drum (16) moving in the same direction as the charge image carrier at a first development gap defined between the first developer drum and the charge image carrier (22); in that further developer drums (17, 18) moving in the same direction as the charge image carrier at further development gaps are provided; and in that the developer mix (11) is then forwarded to a counterrunning developer drum (19) following said further developer drums in a moving direction of the charge image carrier (10) and moving in a direction opposite that of the charge image carrier (10) at a final development gap (22) and means for conducting said developer mix from the counterruning developer drum back into the supply chamber (12), the isorunning developer drums (16, 17, 18) have a circumferential speed that is noticeably higher than the circumferential speed of the charge image carrier (10).

2. A developer station according to claim 1, characterized in that the first isorunning developer drum (16) and a second of the further isorunning developer drums (17) arranged in the moving direction of the charge image carrier are arranged such that the developer mix (11) is again supplied to the transport drum (14) after passing the first development gap (22) and is transported from the transport drum to the second isorunning drum (17).

3. A developer station according to claim 1, characterized in that the transport drum (14) is fashioned as a paddle wheel drum having spokes comprising individual paddles (15).

4. A developer station according to claim 1, characterized in that an illumination means (25, 26) for illuminating the charge image carrier (10) is provided following the further developer drums in the moving direction of the charge image carrier (10).

5. A developer station according to claim 4, characterized in that the illumination means is provided.

6. A developer station according to claim 5, characterized in that the protective drum (26) is arranged at a tight spacing relative to the counterrunning developer drum (19) so that the counterrunning developer drum (19) cleans the protective drum (26) of adhering developer mix (11).

7. A developer station according to claim 1, characterized in that a carrier stripper drum means (28) for picking up carrier parts of the developer mix is arranged in the moving direction of the charge image carrier (10) following the further developer drums (16 through 19).

8. A developer station according to claim 1, characterized in that a suction means (29, 30) that extracts parts of the developer mix that are not bonded to the charge image carrier is provided following the further developer drums in the moving direction of the charge carrier.

9. A developer station according to claim 8, characterized in that an illumination means for illuminating the charge image carrier is provided following the further development drums in the moving direction of the charge image carrier;

a carrier stripper drum means for picking up carrier parts of the developer mix is arranged following the further development in the moving direction of the charge image carrier; and the suction means is arranged between the illumination means and the carrier stripper drum means (28).

* * * * *